US011034895B1

(12) United States Patent
Oza et al.

(10) Patent No.: US 11,034,895 B1
(45) Date of Patent: Jun. 15, 2021

(54) PROCESS FOR PRODUCTION OF ON SPECIFICATION GROUP III/III+ BASE OILS WHILE PRESERVING BASE OIL YIELD

(71) Applicant: Axens North America, Princeton, NJ (US)

(72) Inventors: Trushit Oza, Langhorne, PA (US); Jerome Bonnardot, Fontenay le Fleury (FR)

(73) Assignee: Axens SA, Reuil-Malmaison (FR)

( * ) Notice: Subject to any disclaimer, the term of this patent is extended or adjusted under 35 U.S.C. 154(b) by 0 days.

(21) Appl. No.: 16/749,273

(22) Filed: Jan. 22, 2020

(51) Int. Cl.
*C10G 45/60* (2006.01)
*C10G 67/04* (2006.01)
*C10G 67/14* (2006.01)

(52) U.S. Cl.
CPC ..... *C10G 45/60* (2013.01); *C10G 67/04* (2013.01); *C10G 67/14* (2013.01); *C10G 2300/1007* (2013.01); *C10G 2300/201* (2013.01); *C10G 2300/302* (2013.01); *C10G 2300/304* (2013.01); *C10G 2400/04* (2013.01); *C10G 2400/08* (2013.01)

(58) Field of Classification Search
None
See application file for complete search history.

(56) References Cited

U.S. PATENT DOCUMENTS

2009/0050524 A1* 2/2009 Kim ..... C10G 65/12 208/89
2010/0193400 A1* 8/2010 Kim ..... C10G 69/06 208/51
2011/0219676 A1* 9/2011 Koyama ..... C10G 3/50 44/435
2019/0016973 A1* 1/2019 Murray ..... C10G 7/003

* cited by examiner

*Primary Examiner* — Tam M Nguyen

(57) ABSTRACT

The present invention describes a process for the production of base oils having a viscosity of greater than 4 centistokes from waste oils originating from industrial use or engine use, said process using a novel configuration for efficient and effective processing.

18 Claims, 1 Drawing Sheet

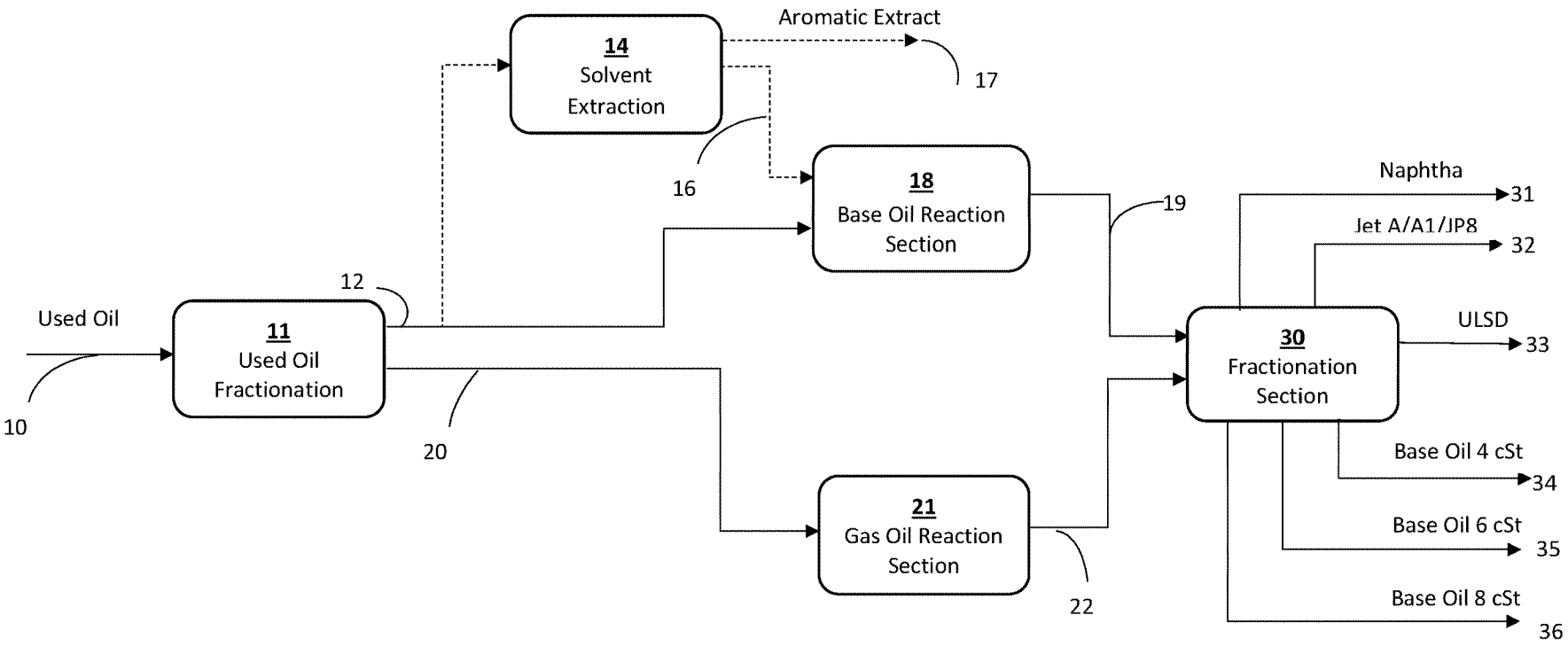
Used Oil
10
11
Used Oil Fractionation
12
14
Solvent Extraction
Aromatic Extract
17
16
18
Base Oil Reaction Section
19
20
21
Gas Oil Reaction Section
22
30
Fractionation Section
Naphtha
31
Jet A/A1/JP8
32
ULSD
33
Base Oil 4 cSt
34
Base Oil 6 cSt
35
Base Oil 8 cSt
36

PROCESS FOR PRODUCTION OF ON SPECIFICATION GROUP III/III+ BASE OILS WHILE PRESERVING BASE OIL YIELD

FIELD OF THE INVENTION

The invention relates to an improved method for processing used waste oil to produce on-specification group III/III+ base oils that can thereafter be blended with the additives to produce engine motor oil.

BACKGROUND

Lubricating oils are used to minimize friction and wear between mechanical parts in contact with each other and are essential to a wide variety of automotive, industrial, and marine applications.

The lifecycle of lubricating oils is associated with environmental impacts including greenhouse gas emissions. The manufacture of lubricating oil is the most energy-intensive process in a crude oil refinery, and used lubricating oils are often burned in industrial or commercial boilers, releasing multiple pollutants including carbon dioxide.

An alternative option exists for used lubricating oil: collection and re-refining. Used oil management programs have been developed to reduce the amount of practical loss of used oil and to encourage the recycle and reuse of used oil. Lubricating oil must be taken out of service when it no longer performs to expected specifications. This occurs when additive packages become depleted and the lubricant becomes contaminated.

The base oil portion of the lubricant, however, does not break down during use. As a result, used engine oil and other lubricating oils can be re-refined to remove water, contaminants and additives to produce base oil of the same quality as the virgin base oil. Lubricants formulated using re-refined base oils in turn can meet the same performance standards as those using virgin base stocks.

Characteristics of the various base oils are generally defined as follows:

Group I base oils are defined as having a viscosity index between 80 and 120, a sulphur content higher than 0.03% wt and saturates are no more than 90% wt. They are made by the solvent extraction of distillate of crude oil. This relative easy method of processing makes the group comparably cheaper than the other, more refined grades. Because of the lower quality in refining, Group I base oils tend to be less in quality. Although they cannot be used for most applications, they still possess a good quality for the mundane applications. Coupled with their cost, this makes them the stock of many lubricants.

Group II base oils are similar to Group I base oils, with the main differences being a higher amount of saturates (above 90% wt) and lower sulphur content (<0.03% wt). In general. Group II base oils perform better than Group I base oils overall but because they need different refining processes, they are more expensive. Instead of solvent extraction, the distillates are hydro-processed.

Group III base Oils are similar to Group II base oils, the difference being a higher viscosity index (above 120). In general Group III base oils perform even better than Group II base oils as they are more hydro-processed. The excellent characteristics make Group III base oils a fine quality product and they are commonly used in conjunction with additives to make high performances lubricants.

Group IV base Oils are defined as Polyalphaolefins (PAO's). These are chemically engineered base oils and have a very low pour point. Because they are synthetic PAO's have excellent quality and perform at the highest levels imaginable.

Group V base oils are defined as every base oil that cannot be placed among the other 4 groups. These include esters, poly-alkylene glycols (PAG), silicones, naphtenics and polybutanes. They generally have extremely high quality parameters as they are synthetic base oils. Table 1 shows some of the properties for the different categories of base oils.

TABLE 1

| Group | Viscosity Index (VI) | Saturates % wt | Sulphur % wt | Description |
|---|---|---|---|---|
| I | 80-120 | <90% | >0.03% | Conventional (Solvents) |
| II | 80-120 | ≥90% | ≤0.03% | Requires hydroprocessing |
| III | >120 | ≥90% | ≤0.03% | Requires severe hydroprocessing, often special feedstocks |
| IV | | | — | PolyAlphaOlefins (PAO) |
| V | | | — | All other basestocks not in Group I - IV including other synthetics |

The base oil industry is now moving towards Group III base stock utilization as new vehicle engines require more of the light viscosity oils. Driven by regulatory stipulations that require reductions in carbon emissions, Original Equipment Manufacturers (OEMs) have moved to new vehicle engine designs that will continue to push the lube industry to higher grade base oil use.

These drivers are expected to move the base oil industry toward light viscosity, premium performance, motor oils that can be achieved by the use of Group III, and Group IV base stocks.

The prior art is limited to production of group I and group II base oils from waste oils as described, for example, in U.S. Pat. No. 7,261,808 which is hereby incorporated by reference. Applicants have addressed the lack of effective waste oil processing methods to make base oils with VI in excess of 120 and cold crank simulator meeting the SAE viscosity grades with the disclosed invention for processing used waste oil to produce on-specification group III/III+ base oils that can be blended with the additives to produce engine motor oil.

Additionally, U.S. Pat. No. 10,174,264 teaches a process for the production of technical white oils or edible or medicinal oils from waste oils originating from industrial use or engine use and is herein incorporated by reference. However, none of the prior art teaches an efficient and effective method to process used or waste oils into group III/IV+ base oils as hereinafter described by Applicants.

SUMMARY OF THE INVENTION

As described above, the base oil industry is moving towards Group III base stock use as new vehicle engines require more of the light viscosity oils. Driven by regulatory stipulations that require reductions in carbon emissions, Original Equipment Manufacturers (OEMs) have moved to new vehicle engine designs that will continue to push the lube industry to higher grade base oil use. Drivers of such vehicles are therefore expected to move the base oil industry toward light viscosity, premium performance, motor oils that can be achieved by the use of Group II, and Group IV base stocks.

Applicants have addressed this new demand with an innovative design utilizing independent reaction section trains processing segregated feeds with high impurities and different processing objectives.

More particularly, Applicants have developed a process for processing of waste oils into a Group II/III+ base feedststock comprising:

a) feeding a used oil feedstock into a fractionator to provide a base oil stream and a gas oil stream;
b) feeding said gas oil stream to a hydrotreatment reactor to provide a hydrotreated full-range diesel stream;
c) feeding said base oil stream to a base oil reactor to provide an upgraded base oil stream;
d) processing said upgraded base oil stream and said hydrotreated full-range diesel stream in a two-step fractionation process wherein said upgraded base oil stream and said hydrotreated full range diesel stream are first atmospherically fractionated and subsequently vacuum fractionated; and wherein said two-step fractionation process provides an ultra-low sulfur diesel stream, a naphtha stream, a jet fuel stream, and a plurality of upgraded base oil streams all having a viscosity of greater than 4 centistokes. The steps a), c) and d) are mandatory to produce Group III/III+ base oils. Optionally, step b) can be incorporated in the process if upgrading of the gas oil to ULSD and/or No. 2 fuel is desired.

Depending upon the properties of the feedstock and desired properties of the base oil streams, step c) may further comprise either:

c1) contacting the partially upgraded used oil in the presence of hydrogen with a hydrodemetallization catalyst;
c2) contacting the effluent of step (c1) in the presence of hydrogen with a hydrotreating catalyst;
c3) contacting the effluent of step (c2) in the presence of hydrogen with a dewaxing catalyst, and
c4) contacting the effluent of step (c3) in the presence of hydrogen with a hydrotreating catalyst.

or c1) contacting said base oil stream in the presence of hydrogen with a hydrodemetallization catalyst; and
c2) contacting the effluent of step (a) in the presence of hydrogen with a hydrotreating catalyst.

BRIEF DESCRIPTION OF THE DRAWINGS

FIG. 1 shows a schematic of Applicant's novel method for processing used waste oil to produce on-specification group III/III+ base oils that can be blended with the additives to produce engine motor oil.

DETAILED DESCRIPTION OF THE INVENTION

FIG. 1 shows a schematic of Applicant's novel method for processing used waste oil to produce on-specification group III/III+ base oils that can be blended with the additives to produce engine motor oil.

The used oils, also called waste oils further in the text, used as feedstock for the process according to the invention are generally mineral oils made up of hydrocarbons, usually but not exclusively of petroleum origin. These oils contain additives such as for example antirust agents, antioxidants, emulsifiers, pour point depressants (PPDs), or viscosity index improvers (VIIs). They have been partly degraded by oxidation or formation of carbon-based residues or unburnt hydrocarbons, after use in an industrial machine or an internal combustion engine. The waste oil feedstock is filtered in order to eliminate the solid particles in suspension, then the water contained in the feedstock is eliminated in a dehydration stage by means of any process known to a person skilled in the art, for example by decanting or moderate heating and optionally distillation.

After processing in accordance with the above, the waste oil stream 10 is fed to a stripper column unit 11 to fractionate the effluent into a blended base oil stock stream 12 and a diesel stream 20. The blended base oil stock stream 12 typically has properties identified in Table 2 below. One column shows the typical properties of the blended base oil stream 12 that would result from a typical original waste oil stream in Europe, which generally has a higher level of contaminants, and the other shows those properties of the blended base oil stream 12 that would result from a typical original waste oil stream from within the U.S., where the contaminants are generally lower.

TABLE 2

| Property | Test Method | Units | Typical stream 12 properties from a European waste oil stream | Typical stream 12 properties from a US waste oil stream |
|---|---|---|---|---|
| Color ASTM | ASTM D6045 | — | <1 | <1 |
| Aromatics, total | IFP 9409 | wt % | 12.1 | 5.69 |
| Viscosity @ 100° C. | | cSt | 4.9 | 4.98 |
| Viscosity Index | ASTM D2270 | | 116 | 121 |
| Pour Point | | ° C. | −9 | −12 |
| Sulfur | IFP 9910 | wppm | 1,930 | 980 |
| Chlorides | Fx | wppm | 5 | 2 |
| Metals | | | | |
| Boron | ICP | wppm | 26 | <1 |
| Copper | | wppm | 21 | <1 |
| Sodium | | wppm | 9 | <1 |
| Phosphorous | | wppm | 1,051 | 8 |
| Silica | | wppm | <1 | 13 |
| Total | | wppm | 1,107 | 21 |

The diesel stream 20 typically has an ASTM D86 T90%, a temperature of between 282° C. and 338° C. and a maximum density of 900 kg/m$^3$. Asphaltenes are also removed in this step.

The processing of spent oil derived blended base oil stock stream 12 and diesel stream 20 in independent reaction sections is a critical feature of Applicant's invention as it allows for the operating conditions optimized in each section to meet the desired product specifications based on those specific feedstock characteristics.

The waste oil stream 10 contains high amount of metal contaminants that are present from the additives blended in the base oil, which is used to lubricate engines. After fractionation in the stripper column unit 11, those metals impurities mainly concentrate in the diesel stream 20 with high concentrations of silica and phosphorous. These metals are catalyst poisons and require large catalyst volume to be loaded in the reactors to account for catalyst deactivation by metals poisoning. In addition, chloride contaminants in the waste oil stream 10 also mainly concentrate in the diesel stream 20.

The diesel stream 20 is thereafter fed to a gas oil reaction hydrotreater 21 where the diesel stream 20 is upgraded by reducing sulfur, nitrogen and/or metal content to create an upgraded diesel feedstock 22 that is ready for the final two step fractionation section 30.

The gas oil reaction hydrotreater 21 generally operates at the following conditions: pressure of 3.5 MPa to 10.0 MPa and preferably at a pressure of between 4.0 MPa to 5.5 MPa; an LHSV of 0.05 to 5 $h^{-1}$ and preferable at LHSV of 0.1 to 1 $h^{-1}$; a H/hydrocarbon ratio of 100 to 5000 $Nm^3/m^3$ of feed; a temperature of between 200 to 400° C. and preferably between 300 to 400° C. (572 to 752° F.); a minimum hydrogen partial pressure of 2.5 MPa.

The catalyst used in the HDS unit 21 can comprise any suitable hydrotreating catalyst, e.g., a catalyst comprising at least one Group VIII metal (for example selected from Ni, Co, and a combination thereof) and at least one Group VIB metal (for example selected from Mo, W, and a combination thereof), optionally including a suitable support and/or tiller material (e.g., comprising alumina, silica, titania, zirconia, or a combination thereof). The hydrotreating catalyst according to aspects of this invention can be a bulk catalyst or a supported catalyst. Techniques for producing supported catalysts are well known in the art.

During hydrotreatment in the hydrotreater 21, the chlorides are converted to HCl. The presence of HCl along with ammonia that is generated in the hydrotreater 21 can quickly precipitate in the heat recovery network, if heat recovery from the reactor effluent is attempted. While the upgraded diesel feedstock 22 yield is low compared to the base oil effluent stream 19 described below. The high concentrations of chlorides and metals can dictate the limits on heat integration and demetallization catalyst inventory.

The blended base oil stock stream 12 is comprised of Group I+/I+/II/II+ base oils and is thereafter optionally sent to a solvent extraction unit 14. The solvent extraction unit 14 removes impurities including sulfur, nitrogen, aromatic compounds and metals thereby creating an aromatic extract stream 17 and an upgraded blended base oil feedstock stream 16 comprised of Group I+/II/II+ base oils. The aromatic extract stream 17 is a byproduct that can be sold as a fuel.

The blended base oil stock stream 12 and upgraded blended base oil feedstock stream 16 would typically have properties as shown in Table 3 below:

TABLE 3

| Type | Unit | Method | Stream 12 | Stream 16 |
|---|---|---|---|---|
| Specific Gravity | | | 0.851 | 0.847 |
| Kinematic viscosity at 100° C. | cSt | D445 | 4.9 | 5.1 |
| Viscosity Index | | | 116 | 118 |
| Sulfur content | wt % | | 589 | 310 |
| Total nitrogen | ppm | D4629 | 790 | <100 |
| Aromatics | wt % | UV | 12.1 | 4.2 |
| Distillation | | | D1160 | D1160 |
| IBP | ° C. | | 228 | 353 |
| 5% | ° C. | | 308 | 367 |
| 10% | ° C. | | 341 | 370 |
| 30% | ° C. | | 371 | 389 |
| 50% | ° C. | | 384 | 393 |
| 70% | ° C. | | 396 | 404 |
| 90% | ° C. | | 399 | 419 |
| 95% | ° C. | | 401 | 421 |
| FBP | ° C. | | 403 | 426 |
| Pour Point | ° C. | | <−10 | −13 |
| Metals and metalloids | wt ppm | | | |
| P | wt ppm | | 42 | 2.3 |
| Si | wt ppm | | 6.5 | BDL |
| Total Metals | wt ppm | | 51.2 | 4.9 |
| Color | | D1500 | 4.1 | 0.9 |

The upgraded blended base oil feedstock stream 16 is significantly improved in terms of feed severity and hence provides incentive to run the solvent extraction unit 14 if this unit already exists in the facility flow scheme. However, the blended base oil stock stream 12 is also suitable for upgrading in the base oil hydrotreater 18 by increasing the severity of operating conditions in the base oil hydrotreater 18. Hence, as shown in FIG. 1, the solvent extraction unit 14 is considered optional in Applicant's novel processing scheme for upgrading of waste motor oil.

The upgraded blended base oil stream 16 can alternatively be derived from either used oil fractionation, fractionation and solvent extraction (furfural or NMP: N-methyl Pyrrolidone as solvent) or fractionation and hydrotreating, or any combination of the aforementioned.

The upgraded blended base oil feedstock 16 or blended base oil stock stream 12 are thereafter sent along with hydrogen (not shown) to the top of the base oil reactor 18 equipped with feed diffuser and high-efficiency liquid distributor tray to distribute the liquid and vapor evenly across the catalyst bed to create a base oil effluent stream 19. The base oil reactor 18 is equipped with liquid distributor tray at the top and in-between each bed in the same reactor to redistribute the vapor and liquid across catalyst beds. The base oil reactor 18 is a downflow reactor with the feed and hydrogen flowing co-currently across all catalyst beds.

The distributed liquid is preferably contacted with hydrodemetallization catalyst to remove metal contaminants. The number of demetallization beds, when present, can range from preferably 1 to 8, even more preferably 1 to 3. In such a case, the effluent from demetallization step is contacted with hydrotreating catalyst, either stacked directly below the demetallization catalyst bed or in separate bed(s) below the demetallization catalyst. The number of hydrotreating beds can preferably range from 1 to 8, even more preferable from 1 to 5.

The base oil reactor 18 generally operates at (i) a temperature between 200° C. and 400° C., (ii) a pressure between 5.0 MPa and 30.0 MPa, and (iii) an LHSV between 0.1 $h^{-1}$ and 10 $h^{-1}$, and wherein the demetallization catalyst has a Group VIIIB metal content between 1 wt % and 10 wt % and a Group VIB metal content between 2 wt % and 15 wt %; (V) subjecting said demetallized product to a hydrotreatment stage in the presence of (i) a supported nickel- and molybdenum-based catalyst, or (ii) a nickel- and tungsten-based catalyst to produce a deep hydrotreated product, wherein the deep hydrotreatment takes place under the following conditions: (i) a temperature of between 250° C. and 450° C., (ii) a pressure between 5.0 MPa and 30.0 MPa, (iii) an LHSV between 0.05 $h^{-1}$ and 10 $h^{-1}$, and (iv) a flow rate of hydrogen between 100 and 3,000 normal liters/liter of feedstock.

Optionally, the effluent from the base oil reactor 18 is contacted with dewaxing catalyst to improve the pour point of the base oil effluent stream 19. The effluent from dewaxing catalyst may preferably be further processed in a small layer of hydrotreating catalyst to treat any color bodies that may have formed in the dewaxing bed. The inlet temperature to the dewaxing catalyst can be the same temperature as the hydrotreating catalyst outlet or can be quenched using hydrogen or effluent product from fractionation to reduce dewaxing catalyst inlet temperature. The quench is injected and combined in mixing device followed by liquid distributor tray. The catalyst used in the different steps may be a single type catalyst or a combination or package of different catalyst having the same functionality.

Suitable dewaxing catalysts are heterogeneous catalysts comprising a molecular sieve or a ZSM-type zeolite and optionally in combination with a metal functionality having a hydrogenation function. Suitable metals are Group VIII metals, for example nickel, cobalt, platinum and palladium. Combinations of platinum and palladium are also possible as well as combinations of nickel or cobalt with Group VIB metals, for example NiMo or NiW. The dewaxing function is carried out by operating catalyst at (i) the same temperature or a temperature lower than hydrotreating catalyst by preferably 150° C., more preferably 40° C., even more preferably lower by 20° C. to same temperature, (ii) a pressure between 5.0 MPa and 30.0 MPa, and (iii) an LHSV between 0.1 $h^{-1}$ and 10 $h^{-1}$, and (iv) a flow rate of hydrogen between 100 and 3,000 normal liters/liter of feedstock. The effluent from dewaxing catalyst is further treated in on hydrotreating catalyst to treat any color bodies that may have had formed during dewaxing. The hydrotreating function is carried out using the hydrotreating catalyst at (i) a temperature of between 250° C. and 450° C., (ii) a pressure between 5.0 MPa and 30.0 MPa, (iii) an LHSV between 1 $h^{-1}$ and 20 $h^{-1}$, and (iv) a flow rate of hydrogen between 100 and 3,000 normal liters/liter of feedstock. In another embodiment the dewaxing catalyst temperature is lowered using hydrogen, recycled fractionated reactor effluent, or a heat exchanger of any type including, but not limited to, TEMA shell-and-tube, plate-frame, spiral channel exchangers The base oil effluent stream 19 along with the upgraded diesel feedstock 22 are thereafter fed to a common fractionation section 30 where these streams undergo several steps, where both streams are processed in common fractionation towers. The first step requires removal of light hydrocarbons and can be achieved either at pressure in a stripper or atmospheric fractionator (not shown) where naphtha and lighter or spindle and lighter cuts are removed depending upon the required products. The operating pressure of this 1' step separation is generally from 0 to 2.0 MPa and at temperatures generally between 65° C. to 370° C.

The second step involves production of lubes under vacuum conditions to produce a light spindle oil cut and a plurality of group III+ base oils having greater than 4 cSt viscosities. As used herein, a plurality means at least 2, preferably at least 3, and most preferably 3 group III+ base oil streams. Fractionating the base oil boiling material produced in reactor 18 in two-step fractionation section 30 allows the bulk base oil fraction to be off-spec for viscosity.

The Group III base oils are sold in specific viscosity ranges for each grade. In a hydrotreater, the total bulk viscosity of the base oil material will be lower for the hydrotreated base oil than the feed base oil. The reactor operating severity is set by either the desulfurization requirement (normally not a constraint), the aromatics saturation requirement (normally not a constraint), the viscosity index improvement requirement or the total bulk viscosity of base oil. In order to preserve the base oil yield, the severity in the base oil reactor 18 would be limited to meet either hydrodesulfurization, aromatics saturation, or the viscosity index improvement requirements.

Preferably, the fractionation section 30 provides a naphtha stream 31, a jet fuel stream (A/A1/JP8) 32 (if desired), an ultra-low sulfur diesel stream 33, a 4 centistoke grade base oil stream 34 (typically 4.0±0.3 cSt), a 6 centistoke grade base oil stream 35 (typically 6.0±0.3 cSt), and/or a 8 centistoke grade base oil stream 36 (typically 8.0±0.3 cSt). Chemical additives may thereafter be added as required to the 4 centistoke grade base oil stream 34, the 6 centistoke grade base oil stream 35, and/or the 8 centistoke grade base oil stream 36.

One example of a chemical additive that can be used is CHIMWEC 6043 with dosage rates preferably from 10 wppm to 10,000 wppm, more preferably from 20 wppm to 500 wppm, even more preferably from 50 wppm to 100 wppm.

The finished product total viscosity at 100° C. specification can be met by fractionation of the bulk base oil effluent into either the 4 centistoke grade base oil stream 34, 6 centistoke grade base oil stream 35, or 8 centistoke grade base oil stream 36 cuts in the second step fractionation. The advantage of fractionation of bulk base oil in specific grades can be seen in Table 4 below with on-specification base oil produced in option 2 and option 4 only.

TABLE 4

| Feed | ALL CASES | | | |
|---|---|---|---|---|
| Viscosity Index | 116 | | | |
| Viscosity @ 100° C. | 5.0 | | | |
| | Option 1 | Option 2 | Option 3 | Option 4 |
| Heating Oil | (150° C.-280° C.) | (150° C.-280° C.) | (150° C.-350° C.) | (150° C.-280° C.) |
| Yield, w % of FF | 11% | 9% | 25% | 9% |
| Light Lube | Spindle | Spindle | | Spindle |
| Yield, w% of FF | 20% | 59% | | 17% |
| Visc @ 40° C. | 8.9 | 15 | — | 8.9 |
| Visc @ 100° C. | 2.55 | 3.5 | — | 2.4 |
| VI | — | 112 | — | — |
| Heavy Lube 1 | 4 cSt Gr III | 6 cSt Gr III | 4 cSt Gr III | 4 cSt Gr III |
| Yield, w % of FF | 63% | 28% | 69% | 37% |
| Visc @ 40° C. | 22.05 | 33 | 19 | 18.8 |
| Visc @ 100° C. | 4.6 | 6.03 | 4.2 | 4.2 |
| VI | 126 | 130 | 127 | 127 |
| Noack | <13 | <13 | 18-25 | <13 |
| Heavy Lube 2 | | | | 6 cSt Gr III |
| Yield, w% of FF | | | | 33% |
| Visc @ 40° C. | | | | 32.5 |
| Visc @ 100° C. | | | | 6.0 |
| VI | | | | 129.6 |
| Noack | | | | <8 |

As illustrated above, the two-step fractionation and production of various grades of Group III/III+ base oils results in higher yield of total base oils produced in the unit. The operating pressure of this second step separation generally ranges from between 7 mmHg (abs) to 760 mmHg (abs) and temperatures generally between 65° C. to 370° C. The vacuum system can be either multiple stages of vacuum pumps, ejectors and any combination of the aforementioned two equipment with or without pre-condenser.

In the second step fractionation, at least two products are separated, a spindle oil cut and one of the group II/III+ viscosity grade base oil. The Group II/III+ base oil produced in the second step will meet the NOACK specification and the viscosity range for each grade. In this process, the second step fractionation can produce either only a spindle cut and one grade of Group II/III+ base oil, or a spindle cut and two grades of Group III/III+ base oils, or a spindle cut and three grades of Group III/III+ base oils. The preference for number of base oil grades fractionated are not limited and is based on the waste oil feed composition. Any combination of number of base oils produced in the second fractionation step will meeting the quality specifications of at least one of the grades summarized in Table 5 hereafter.

TABLE 5

| Type | Unit | Gr III 8 cSt grade | Gr III 6 cSt grade | Gr III 4 cSt grade |
|---|---|---|---|---|
| Specific Gravity | | 0.85 | 0.84 | 0.84 |
| Kinematic viscosity at 100° C. | cSt | 8.0 ± 0.3 | 6.0 ± 0.3 | 4.0 ± 0.3 |
| Viscosity Index | | ≥125 | ≥125 | ≥123 |
| Sulfur content | wppm | <20 | <20 | <20 |
| NOACK | wt % | ≤10 | ≤10 | ≤15 |
| Saturates | wt % | ≥98 | ≥98 | ≥98 |
| Pour Point | ° C. | ≤−12 | ≤−15 | ≤−21 |
| Cold Crank Simulator | mPa·s | <13,000 @ 10° C. | 1,100 @ −20° C. | 2,450 @ −35° C. |

Additionally, when 4 cSt grade base oil and 6 cSt grade base oil or 4 cSt grade base oil, 6 cSt grade base oil and 8 cSt grade base oil products are required to be produced, the following design considerations are taken in to account for the second step of fractionation: limit flash zone temperature to less than 350° C., overflash 30/6-600% of the bottoms product flow rate, and the overflash is re-routed to the Vacuum Column Heater inlet, stripping steam injection rate of 50-500 kg/Sm3 bottom product, preferably 110-120 kg/Sm3 of bottom product with steam injected either at the heater inlet only or at the Vacuum Fractionator bottom only or at both locations, the heater inlet and the Vacuum Fractionator bottom in any ratio.

All of the aforementioned base oil streams are group III/III+ grade base oils and can thereafter be utilized to manufacture light viscosity, premium performance motor oils.

Example 1

This invention will be further described by the following example, which should not be construed as limiting the scope of the invention.

A bulk waste oil stream is processed in a waste oil re-refinery. The bulk waste oil is fractionated to dehydrate and fractionate the following streams: naphtha and light ends, diesel, base oil and asphalt flux. The diesel and base oil fraction of the waste oil is used as feed for this example. The relevant properties of this feed are listed in Table 6 below:

TABLE 6

| Type | Unit | Method | Base Oil | Diesel |
|---|---|---|---|---|
| Specific Gravity | | | 0.851 | 0.852 |
| Kinematic viscosity at 100° C. | cSt | D445 | 4.9 | 2.0 |
| Viscosity Index | | | 116 | — |
| Sulfur content | wt % | | 589 | 2,200 |
| Total nitrogen | ppm | D4629 | 790 | 800 |
| Aromatics | wt % | UV | 12.1 | 22.0 |
| Distillation | | | D1160 | D86 |
| IBP | ° C. | | 228 | 206 |
| 5% | ° C. | | 308 | 216 |
| 10% | ° C. | | 341 | 223 |
| 30% | ° C. | | 371 | 248 |
| 50% | ° C. | | 384 | 276 |
| 70% | ° C. | | 396 | 301 |
| 90% | ° C. | | 399 | 335 |
| 95% | ° C. | | 401 | 345 |
| FBP | ° C. | | 403 | 368 |

-continued

TABLE 6

| Type | Unit | Method | Base Oil | Diesel |
|---|---|---|---|---|
| Pour Point | ° C. | | <−10 | −11 |
| Metals and metalloids | | | | |
| P | wt ppm | | 42 | 532 |
| Si | wt ppm | | 6.5 | 32 |
| Total Metals | wt ppm | | 51.2 | 578 |
| Color | | D1500 | 4.1 | 3.5 |

The diesel stream is hydrotreated for sulfur removal in atypical diesel hydrotreater with hydrotreating catalysts. The high metals content in the feed requires contact of diesel with demetallization catalyst followed by hydrotreating catalyst in presence of hydrogen. The typical operating conditions and yields in the diesel hydrotreating section are: WART, 320-390° C., hydrogen partial pressure 4.6 MPa min, an $H_2$/HC recycle ratio of 500 $Sm^3/m^3$, a diesel yield>98 w %, and an effluent diesel sulfur content, <10 wppm.

The base oil stream is thereafter hydroprocessed in a hydrotreater. Table 7 below shows two different operating conditions based on whether a dewaxing catalyst is or is not utilized. In the operating scenario when no dewaxing catalyst is utilized to meet the base oil pour point, chemical additives blending is required to lower the base oil pour point to the commercial Group III base oil specification of −15° C. Dewaxing catalyst is utilized to improve the pour point of the treated base oil catalytically and the conditions and effluent stream properties in those two possibilities are summarized in Table 7 below:

TABLE 7

| Condition | | No dewaxing catalyst utilized | Dewaxing catalyst utilized |
|---|---|---|---|
| Reactor Pressure | MPa | 10.5 | 10.5 |
| WABT (HDM/HDT) | ° C. | 340 | 343 |
| WABT (Dewaxing) | ° C. | | 315 |
| HDM/HDT Catalyst LHSV | $h^{-1}$ | 0.25 | 0.25 |
| Dewaxing Catalyst LHSV | $h^{-1}$ | | 1.5 |
| 4 cSt Product | | | |
| Viscosity @ 100° C. | cSt | 4.0 | 4.0 |
| Viscosity Index | | 124 | 123 |
| Pour Point | ° C. | −7 | −21 |
| Sulfur | wppm | <0.3 | <0.3 |
| CCS @ −35° C. | mPa·s | 2,600 | 2,450 |
| 6 cSt Product | | | |
| Viscosity @ 100° C. | cSt | 6.0 | 6.0 |
| Viscosity Index | | 136 | 135 |
| Pour Point | ° C. | −9 | −15 |
| Sulfur | wppm | <0.3 | <0.3 |
| CCS @ −20° C. | mPa·s | 1,200 | 1,100 |

The treated effluent from diesel reaction section and base oil reaction sections are thereafter fractionated in a two-step process with group II/III+ base oils derived from ex-fractionation having properties shown in Table 5 above in the Detailed Description of the Invention section of this Application.

The two-step fractionation process is specifically designed to meet the product specifications using distillation without degrading the product quality. In this case, it is important to maintain the effluent operating temperature below 390° C. and more preferably below 350° C. As a result, the first step is typically performed at pressures between 0.02 MPa to 1.0 MPa, where the light fractions such as naphtha and/or Jet A/A1/JP8 and/or ULSD is separated while maintaining the temperatures below 350° C. The second step of separations is carried out under vacuum conditions, with the operating pressure between 5 mmHg (abs) and 600 mmHg (abs).

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

We claim:

1. A novel configuration for the processing of waste oil into a Group III/III+ base stock comprising:

a) feeding a used oil feedstock into a fractionator to provide a base oil stream and a gas oil stream;

b) feeding said gas oil stream to a hydrotreatment reactor to provide a hydrotreated full-range diesel stream;

c) feeding said base oil stream to a base oil reactor to provide an upgraded base oil stream;

d) processing said upgraded base oil stream and said hydrotreated full-range diesel stream in a two-step fractionation process wherein said upgraded base oil stream and said hydrotreated full range diesel stream are first atmospherically fractionated and subsequently vacuum fractionated; and wherein said two-step fractionation process provides an ultra-low sulfur diesel stream, a naphtha stream, a jet fuel stream, and a plurality of upgraded base oil streams each having a viscosity of greater than 4 centistokes.

2. The process of claim 1 wherein said base oil stream from step a) is processed in a solvent extraction unit prior to being fed to said base oil reactor in step c).

3. The process of claim 1 wherein said plurality of upgraded base oil streams have a viscosity of greater than 6 centistokes.

4. The process of claim 1 wherein said base oil reactor from step c) comprises:

a) contacting said base oil stream in the presence of hydrogen with a hydrodemetallization catalyst; and (b) contacting the effluent of step (a) in the presence of hydrogen with a hydrotreating catalyst.

5. The process of claim 1 wherein said base oil reactor from step c) comprises:

a) contacting said base oil stream in the presence of hydrogen with a hydrodemetallization catalyst;

(b) contacting the effluent of step (a) in the presence of hydrogen with a hydrotreating catalyst, (c) contacting the effluent of step (b) in the presence of hydrogen with a dewaxing catalyst; and (d) contacting the effluent of step (c) in the presence of hydrogen with a hydrotreating catalyst.

6. The process of claim 1 wherein said base oil reactor from step c) comprises between 1 and 8 hydrotreating beds.

7. The process of claim 1 wherein said base oil reactor from step c) comprises between 1 and 3 hydrotreating beds.

8. The process of claim 1 wherein said base oil reactor from step c) operates at a temperature between 200° C. and 400° C., a pressure between 5.0 MPa and 30.0 MPa, and an LHSV between 0.1 $h^{-1}$ and 10 $h^{-1}$.

9. The process of claim 1 wherein said base oil reactor from step c) operates at a temperature between 200° C. and 400° C., a pressure between 5.0 MPa and 30.0 MPa, and an LHSV between 0.1 $h^{-1}$ and 10 $h^{-1}$, and further wherein the demetallization catalyst has a Group VIIIB metal content between 1 wt % and 10 wt % and a Group VIB metal content between 2 wt % and 15 wt %.

10. The process of claim 1 wherein a dewaxing catalyst is used in said base oil reactor in step c).

11. The process of claim 1 wherein said atmospheric fractionation in step d) is performed at pressures of between 0 to 2.0 MPa and at temperatures between 65° C. to 370° C.

12. The process of claim 1 wherein said vacuum fractionation in step d) is performed at pressures between 7 mmHg (abs) to 760 mmHg (abs) and at temperatures between 65° C. to 370° C.

13. The process of claim 1 wherein said base oil reactor from step c) operates at a pressure of 3.5 to 10.0 MPa, an LHSV of 0.05 to 5 $h^{-1}$, a $H_2$/hydrocarbon ratio of 100 to 5000 $Nm^3/m^3$ of feed, a temperature of between 200 to 400° C., and a minimum hydrogen partial pressure of 2.5 MPa.

14. The process of claim 1 wherein said hydrotreatment reactor from step b) operates at a pressure of between 4.0 to 5.5 MPa, an LHSV of 0.1 to 1 $h^{-1}$, a $H_2$/hydrocarbon ratio of 100 to 5000 $Nm^3/m^3$ of feed, a temperature between 300 to 400° C. (572 to 752° F.) and a minimum hydrogen partial pressure of 2.5 MPa.

15. The process of claim 1 wherein said hydrotreatment reactor from step b) utilizes catalyst comprising at least one Group VIII metal and at least one Group VIB metal.

16. The process of claim 1 wherein the catalyst utilized in said hydrotreatment reactor from step b) is either a bulk catalyst or a supported catalyst.

17. The process of claim 1 wherein said base oil reactor in step c) is operated between 0 MPa and 8.0 MPa higher than said hydrotreatment reactor in step b).

18. A novel configuration for the processing of waste oil into a Group III/III+ base stock comprising:

a) feeding a used oil feedstock into a fractionator to provide a base oil stream and a gas oil stream;

b) feeding said base oil stream to a base oil reactor to provide an upgraded base oil stream;

c) processing said upgraded base oil stream and said hydrotreated full-range diesel stream in a two-step fractionation process wherein said upgraded base oil stream and said hydrotreated full range diesel stream are first atmospherically fractionated and subsequently vacuum fractionated; and wherein said two-step fractionation process provides an ultra-low sulfur diesel stream, a naphtha stream, a jet fuel stream, and a plurality of upgraded base oil streams each having a viscosity of greater than 4 centistokes.

* * * * *